US009180574B2

(12) United States Patent
Wunder et al.

(10) Patent No.: US 9,180,574 B2
(45) Date of Patent: Nov. 10, 2015

(54) METHOD AND DEVICE FOR PRODUCING A BASE BODY WITH HARD MATERIAL PARTICLES

(75) Inventors: Sherline Wunder, Wallisellen (CH); Christoph Rudolf, Wallisellen (CH); Benno Zigerlig, Untersiggenthal (CH); Friedrich Kuster, Neuhaus (CH)

(73) Assignee: Reishauer AG, Wallisellen (CH)

( * ) Notice: Subject to any disclaimer, the term of this patent is extended or adjusted under 35 U.S.C. 154(b) by 699 days.

(21) Appl. No.: 13/422,693

(22) Filed: Mar. 16, 2012

(65) Prior Publication Data

US 2012/0240475 A1 Sep. 27, 2012

(30) Foreign Application Priority Data

Mar. 22, 2011 (CH) ..... 492/11

(51) Int. Cl.

| | |
|---|---|
| ***B24B 1/00*** | (2006.01) |
| ***B24D 3/00*** | (2006.01) |
| ***B24D 11/00*** | (2006.01) |
| ***B24D 18/00*** | (2006.01) |
| ***C09K 3/14*** | (2006.01) |

(52) U.S. Cl.

CPC ..... *B24D 18/0072* (2013.01)

(58) Field of Classification Search

USPC ..... 51/295, 293

See application file for complete search history.

(56) References Cited

U.S. PATENT DOCUMENTS

| | | | | |
|---|---|---|---|---|
| 6,739,943 | B2 * | 5/2004 | Wirz | 451/5 |
| 6,805,617 | B2 * | 10/2004 | Wirz | 451/47 |
| 8,113,915 | B2 * | 2/2012 | Jankowski et al. | 451/47 |
| 8,597,085 | B2 * | 12/2013 | Rudolf | 451/443 |
| 2003/0046874 | A1 * | 3/2003 | Kim | 51/298 |

FOREIGN PATENT DOCUMENTS

| | | |
|---|---|---|
| EP | 1208945 B1 | 7/2005 |

* cited by examiner

*Primary Examiner* — James McDonough
(74) *Attorney, Agent, or Firm* — Brian Roffe

(57) ABSTRACT

In a method for producing a base body with hard material particles, an adhesive is first of all applied with a defined film thickness to the entire or parts of the working surface of the tool to be produced. Next, the hard material particles are applied to the regions of the working surface provided with the adhesive for lasting adhesion. Hard material particles are applied evenly by an apparatus and are then transferred to the working surface of the tool to be produced provided with the adhesive, on which they remain adhered before the adhesive has hardened. This method enables rapid coating of the working surface of the tool with a predeterminable uniform number of detached hard material particles per unit of area.

12 Claims, 3 Drawing Sheets

10
11'
19
15
14
32
31
30
19
11'
19
20
19
18
33
11
11'
17
11'

21
20
20`
23
22

METHOD AND DEVICE FOR PRODUCING A BASE BODY WITH HARD MATERIAL PARTICLES

FIELD OF THE INVENTION

A method for producing a base body with hard material particles, preferably superabrasives, in which first of all an adhesive is applied with a defined film thickness to the entire or parts of the working surface of the tool to be produced, and that the hard material particles are then applied to the regions of the working surface provided with the adhesive film for lasting adhesion; and devices for implementing the method.

BACKGROUND OF THE INVENTION

In a generic method according to publication EP-A-1 208 945 for producing abrasive tools (which is incorporated by reference herein), an adhesive in droplet form is first of all applied to a carrier. Hard material particles are then dispersed over the carrier provided with droplets of adhesive, and thereby only the hard material particles which come into contact with an adhesive droplet should remain adhered to the carrier.

OBJECTS AND SUMMARY OF THE INVENTION

It is the object of the present invention to provide a method for coating base bodies of the type mentioned at the start which enables rapid coating of a base body with detached hard material particles and guarantees reliable adhesion of the latter to the base body until they are anchored by a subsequent process by soldering.

According to the invention, this object may be achieved by a method according for producing a base body with hard material particles, preferably superabrasives, in which first of all, an adhesive is applied with a defined film thickness to the entire or parts of the working surface of the tool to be produced, and the hard material particles are then applied to the regions of the working surface provided with the adhesive for lasting adhesion, and further, the hard material particles are applied by an appropriate apparatus and are then transferred to the working surface of the tool to be produced provided with the adhesive on which they remain adhered before the adhesive has hardened.

This object may also be achieved by a device for implementing the method wherein a container in the form of a trough is arranged with horizontal alignment of its contact surface and is positioned height-adjustably on a holder, the hard material particles being distributed regularly in the container. In another device, the contact surface, the conveyor belt and/or the dispersing apparatus is/are arranged such that their position and orientation in relation to the working surface to be coated of the tool to be produced can be changed arbitrarily. In another device, the position of the working surface to be coated of the tool to be produced can be moved, as one wishes, continuously or step by step in relation to the contact surface, the conveyor belt and/or the dispersing apparatus. In another device, an adjusting apparatus holds and moves the base body and is made up of a stand, a chuck fastened to the stand for holding the tool to be produced and a motor, it being possible to couple the motor to the base body such that it executes rotations about its axis of rotation.

The method according to the invention makes provision such that first of all an adhesive film is applied evenly to the entire or to part of the working surface of the tool to be produced.

For the coating of the adhesive surface with detached hard material particles the method according to the invention makes provision such that the hard material particles are first of all distributed evenly over a contact surface or a conveyor belt or a dispersing apparatus (sieve), the tool is placed above or below this, and the latter are positioned a predetermined distance away from one another. Next, these hard material particles are moved from the contact surface onto the working surface of the tool to which the adhesive film has been applied so that the latter remain adhered to the working surface.

By forming zones of partial areas, different coating densities or zone-dependent hard material particle types and/or sizes are also provided, and this can be achieved e.g. by repeating the method described above.

This method according to the invention enables rapid coating of the working surface of the tool with a predeterminable uniform number of detached hard material particles per unit of area.

Exemplary embodiments and further advantageous details of this method and these devices are defined in the dependent claims.

BRIEF DESCRIPTION OF THE DRAWINGS

Exemplary embodiments and further advantages of the invention are described in more detail below using drawings. These show as follows.

DETAILED DESCRIPTION OF THE INVENTION

Figure 2:
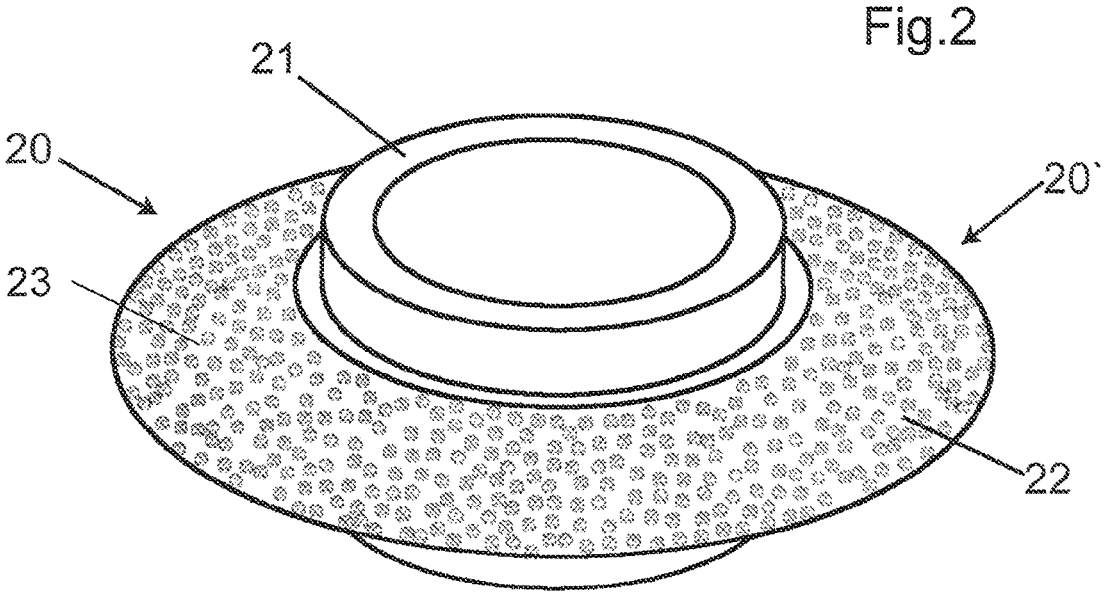
FIG. 2 is a perspective view of a tool which is coated with hard material particles on its working surface.

With the method tools 20 with any surface geometry, such as for example grinding, honing and dressing tools of all types, as shown, for example, in FIG. 2, are coated on their working surfaces 20' with abrasive hard material particles. Different materials, such as superabrasives or other highly abrasive materials, can be used as these hard material particles 22.

In the method an adhesive is first of all applied, in a way known in its own right, with a defined film thickness to substantially the entire working surface of the base body.

According to the invention the hard material particles 22 are first of all distributed evenly over a contact surface 15. The base body of the tool 20 to be produced, which has an adhesive film over the zones to be coated or over the entire working surface, is placed over this contact surface 15 so that the base body is positioned a pre-determined distance away from the contact surface 15. Next, the hard material particles 22 are moved up from the contact surface 15 to the working surface 20' of the base body 20 to which the adhesive film has been applied so that they remain adhered to the adhesive film on the working surface 20'.

Figure 1:
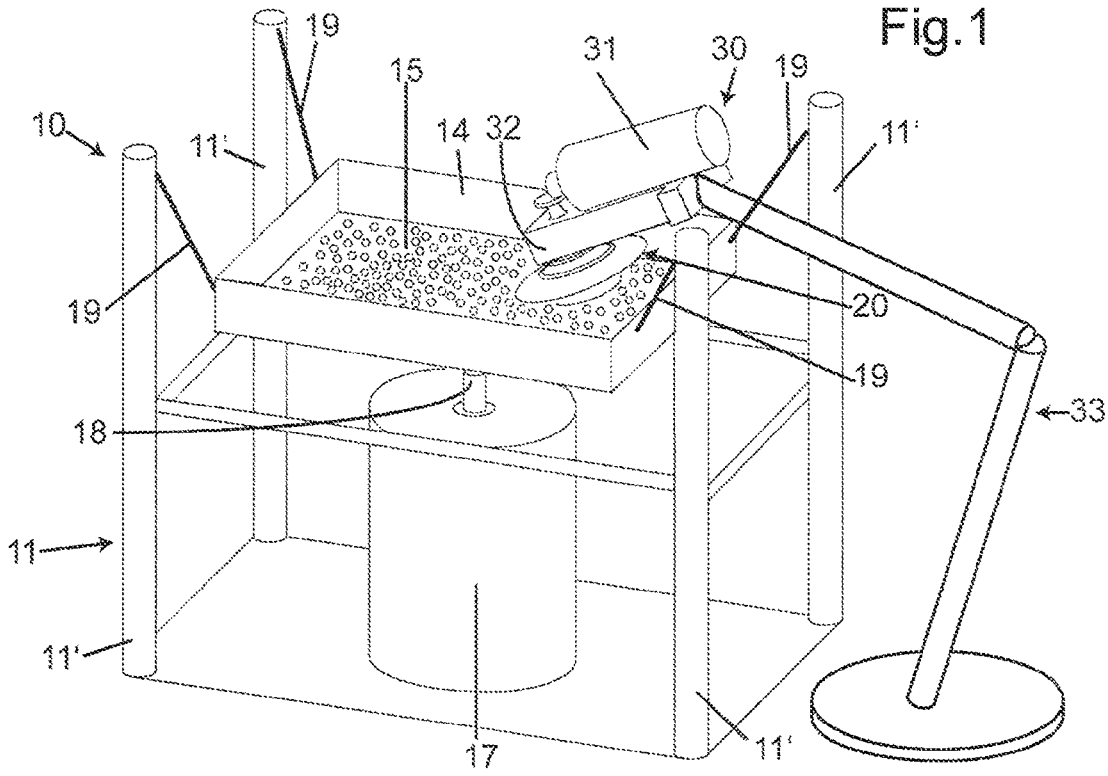
FIG. 1 shows a device for coating a base body with detached hard material particles for implementing the method according to the invention.

According to FIG. 1, the device 10 according to the invention for implementing the method comprises a container 14 held on a frame 11 with a number of stands 11', a drive 17 connected to the latter for producing the upwards and downwards movement of the container approximately perpendicular to the surface, and an adjusting apparatus 30 holding and moving the tool 20 to be produced.

This planar trough-like container 14 is arranged with horizontal alignment of its contact surface 15 and is positioned height-adjustably on a holder that has flexible longitudinal elements 19. By means of this mounting the container 14 can be moved up and down, there being provided for this purpose a plunger 18 of the drive 17 engaging with the lower side of the container 14 and which is arranged approximately perpendicular to the container and, with its front end staying in contact with the container, implements by means of the drive 17 an upwards and downwards movement.

With this shaking motion produced on the container 14 and so on these hard material particles 22 lying loosely in the container, the particles 22 are lifted from the contact surface 15 of the container 14 and moved upwards to the working surface 20' of the tool 20, and remain adhered to the tool 20. The hard material particles 22 are thereby arranged distributed in a single layer in the container 14 and, if required, are topped up again during coating. The plate-shaped container 14 forming the contact surface can be used by means of movements parallel to the contact surface 15 in order to affect the distribution of the hard material particles 22 lying loosely on the contact surface 15.

In a further inventive step, the tool 20 is moved continuously or step by step above the contact surface 15 so that the part of the working surface 20' to be provided with the hard material particles 22 is always the same distance away from the contact surface. Such adjustment is required when this working surface 20' is not designed as a level surface but, as shown for example in FIG. 2, is in the form of a truncated cone.

For this purpose, within the framework of the invention this adjusting apparatus 30 holding and moving the base body 20 is provided, comprising a stand 33, a chuck 32 fastened to the latter for holding the tool, and a motor 31, it being possible to couple the motor 31 to the tool to be produced such that the latter executes a rotation about its axis of rotation. Alternatively, the adjusting apparatus could be a robot or manipulator by means of which the positioning of the base body would take place automatically.

For the coating of the working surface 20' of this cone-shaped tool 20 provided as a grinding, honing or dressing disc 20 with a cylindrical shaft 21 shown in FIG. 2, the container 14 is designed such that there is a short distance of e.g. approx. one centimeter between the contact surface 15 and this working surface 20'.

For the overall control of the device 10 for this coating process, an electric control system (not illustrated) is advantageously provided by means of which this continuous or step by step movement of the tool 20 and the drive for the upwards and downwards movement of the container can be controlled by means of a computer or the like. The predetermined density per area of unit of the hard material particles over the working surface of the tool can thus be more easily controlled by this control system by, for example, the frequency, amplitude, time of the vibration excitation of the contact surface or the rotational speed of the base body being controlled.

Figure 3:
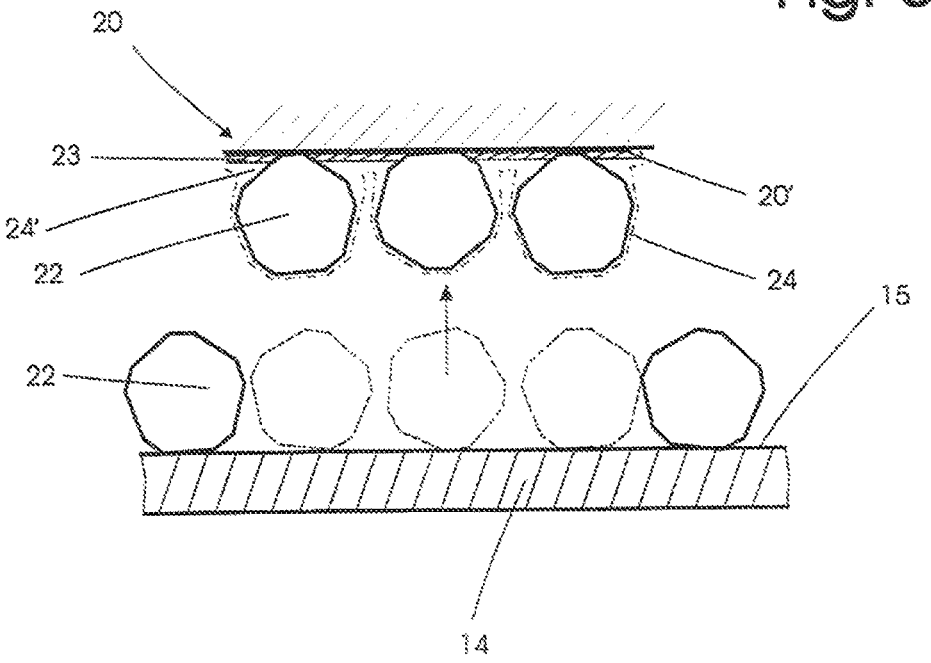
FIG. 3 is a partial section through the container and the tool with a view of a number of hard material particles which have been applied by the method according to the invention.

In FIG. 3, an enlarged section of the partially visible container 14 and tool 20 with a view of the hard material particles 22 is shown.

After the coating of the working surface 20', hardening of the adhesive then takes place, followed, e.g. by the controlled application of a solder layer 24 to the entire coated working surface. In addition to the solder layer, solder matrix reinforcement, consisting of substantially smaller hard material particles and binders, can be applied to the working surface of the tool coated with hard material particles and anchored securely to the base body by means of subsequent soldering for definitive firmly bonded anchoring of the hard material particles 22 by means of the solder 22, possibly with additional solder matrix reinforcement.

Figure 4:
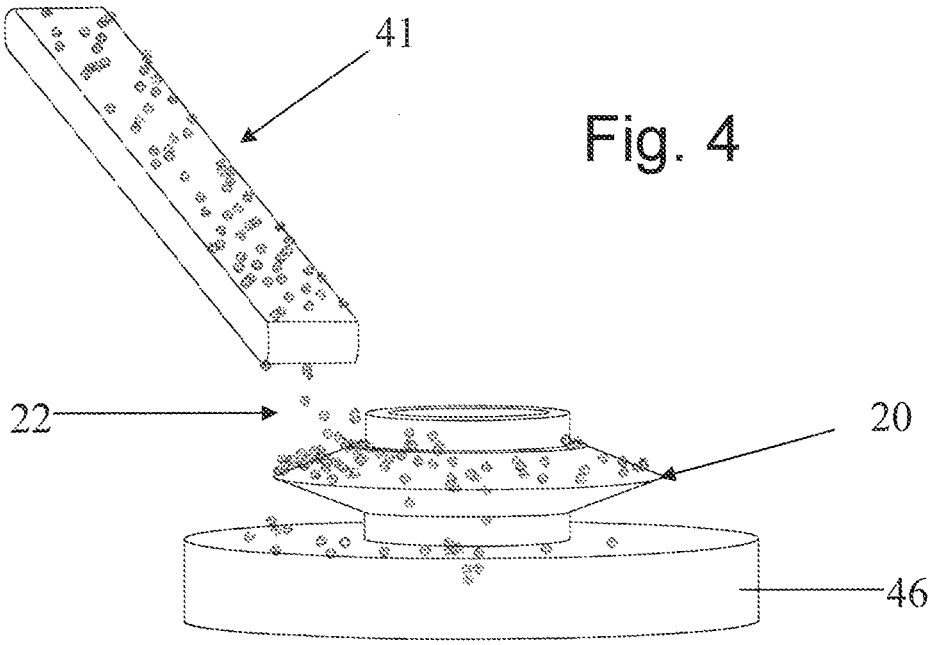
FIG. 4 shows a version of a device in a diagrammatic perspective representation.

According to FIG. 4, a version of a device 40 according to the invention comprises a belt-shaped conveyor apparatus 41 which supplies hard material particles 22 continuously and evenly. The belt-shaped conveyor apparatus 41, which moves at a continuous speed, is charged on the incoming side with hard material particles 22 which are then conveyed over a specific length and are separated here, fall onto this rotating working surface of the base body 20 to which adhesive film has been applied, and remain adhered.

Figure 5:
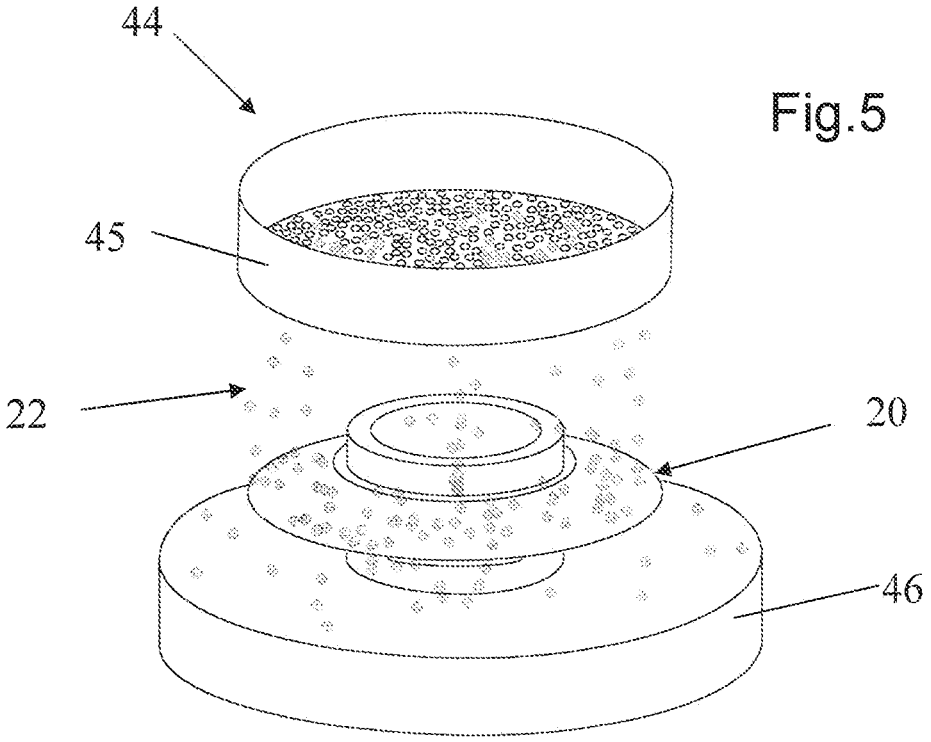
FIG. 5 shows a further version of a device in a diagrammatic perspective representation.

According to FIG. 5, a device 44 according to the invention comprises a dispersing apparatus 45, for example a sieve, which is advantageously moved to and from mechanically, and the hard material particles 22 fall evenly through the holes in the sieve onto the rotating base body 20 provided with an adhesive film and remain adhered to the latter.

Within the framework of the invention the contact surface 15, the conveyor belt 41 and the dispersing apparatus 45 can be set in any position or orientation in relation to the working surface 20' to be coated of a tool 20 or similar to be produced. Specific coating with hard material particles over the working surface can thus be made possible.

The position of the working surface 20' to be coated of the tool 20 to be produced can be moved, as one wishes, continuously or step by step in relation to the contact surface 15 or the conveyor belt 41 or the dispersing apparatus 45.

The adhesive could also be understood as meaning a bonding agent which could be made, for example, of a doughy to liquid metal layer in which the grains are then correspondingly embedded.

The invention claimed is:

1. A method for producing a tool with hard material particles, comprising:

applying an adhesive to at least part of a working surface of a tool, separating hard material particles from one another on a surface of a separating apparatus, the separating apparatus comprising a container forming a contact surface that constitutes the surface of the separating apparatus on which the hard material particles are separated, and then transferring from the surface of the separating apparatus, the separated hard material particles to the working surface of the tool to be produced to which the adhesive is applied such that the hard material particles remain adhered to the tool prior to hardening of the adhesive, the step of transferring the separated hard material particles from the contact surface of the container to the working surface of the tool comprising moving the container upwards over a stroke by means of a shaking motion in a direction approximately perpendicular to the contact surface, such that the hard material particles on the contact surface lift and are moved upwards to the working surface of the tool to which adhesive is applied and remain adhered to the tool.

2. The method according to claim 1, wherein the step of separating the hard material particles from one another comprises moving the container parallel to the contact surface in order to distribute the hard material particles on the contact surface.

3. The method according to claim 1, wherein electrical control of continuous or step by step movement of the tool and of the separating apparatus takes place, by means of which, density per unit of area of the hard material particles over the working surface of the tool is settable.

4. The method according to claim 1, wherein the working surface of the tool comprises a plurality of zones which are coated with hard material particles sequentially so that density, size and other properties of the hard material particles is individually specific to each of the zones.

5. The method according to claim 1, further comprising connecting the hard material particles to the tool by an anchoring process.

6. The method according to claim 5, further comprising anchoring the hard material particles, firmly bonded, on the tool using an adapted soldering process.

7. The method according to claim 6, wherein the appropriate soldering process is made up of the adapted method for applying the solder and final soldering in a furnace in inert gas or a vacuum.

8. The method according to claim 6, further comprising applying, in addition to the solder, solder matrix reinforcement, consisting of substantially smaller hard material particles and binders, to the working surface coated with hard material particles of the tool.

9. The method according to claim 1, further comprising moving the tool continuously or step by step above or below the contact surface of the container on which the hard material particles are separated such that the part of the working surface to be provided with the hard material particles is always the same distance away from the contact surface.

10. The method according to claim 1, further comprising positioning the separating apparatus such that the surface of the separating apparatus is a distance from the working surface of the tool to require the hard material particles to pass through a space between the surface of the separating apparatus and the working surface during the transfer of the hard material particles from the surface of the separating apparatus to the working surface of the tool.

11. The method according to claim 1, further comprising controlling the separating apparatus to obtain a uniform distribution of the hard material particles on the surface of the separating apparatus.

12. The method according to claim 1, further comprising moving the tool relative to the separating apparatus during the transfer of the hard material particles from the surface of the separating apparatus to the working surface of the tool.

* * * * *